United States Patent [19]

Fattler

[11] 4,253,659

[45] Mar. 3, 1981

[54] TOY BALLOON PUMP

[76] Inventor: Karl W. Fattler, 33-06 31st Ave., Long Island City, N.Y. 11106

[21] Appl. No.: 77,036

[22] Filed: Sep. 19, 1979

[51] Int. Cl.[3] ..... A63G 17/00

[52] U.S. Cl. ..... 272/52.5; 272/53.1; 272/130; 280/1.14; 417/229

[58] Field of Search ..... 272/52.5, 52, 53.1, 272/53.2, 130, 1 R, 54, 55, 56, 66, 111; 273/86 E, 86 H; 46/90, 88, 87, 44, 41, 42, 89, 112, 174, 175 R, 175 AR, 176; 104/22, 60, 61; 40/406, 411, 414, 455; 174/176; D21/64, 69, 70, 74, 75, 84, 148, 149, 150, 157, 165, 193, 242, 243; 417/229, 230, 231; 297/181, 188, 217, 271, DIG. 3, DIG. 8; 280/1, 1.1 R, 1.1 A, 1.11 R, 1.12, 1.13, 1.14, 1.16, 1.165, 1.167, 1.173, 1.175, 1.177, 1.181, 1.182, 1.183, 1.184, 1.186, 1.188, 1.189, 1.191, 1.192, 1.193, 1.194, 1.195, 1.196, 1.201, 1.202, 1.203, 1.204, 1.206, 1.207, 1.208, 1.21, 1.22, 3

[56] References Cited

U.S. PATENT DOCUMENTS

| | | | |
|---|---|---|---|
| 1,525,843 | 2/1925 | White, Jr. | 280/1.14 |
| 1,829,680 | 10/1931 | Schelle et al. | 280/1.14 UX |
| 2,348,250 | 5/1944 | Gardner et al. | 46/87 UX |
| 2,598,204 | 5/1952 | Allen | 272/130 X |
| 2,636,315 | 4/1953 | Morsch | 46/88 |
| 2,825,563 | 3/1958 | Lawton | 272/130 |
| 2,915,311 | 12/1959 | Delano | 272/53.1 |
| 2,971,758 | 2/1961 | Zimmers | 46/175 R X |
| 3,062,542 | 11/1962 | Evancha | 272/130 X |

FOREIGN PATENT DOCUMENTS

| | | | |
|---|---|---|---|
| 1019069 | 10/1952 | France | 272/53.1 UX |
| 510532 | 1/1955 | Italy | 272/53.1 |

*Primary Examiner*—Richard C. Pinkham
*Assistant Examiner*—Arnold W. Kramer
*Attorney, Agent, or Firm*—Richard L. Miller

[57] ABSTRACT

A child's riding device such as a hobby horse, ship, locomotive or the like, including a tubular horn on which a balloon may be fitted, an air pump inside the hobby horse connected to the horn for inflating the balloon, the pump being powered by a motor-driven mechanism that also reciprocally shifts the hobby horse forwardly and rearwardly, back and forth, upon a stand, while a child rides thereupon.

3 Claims, 4 Drawing Figures

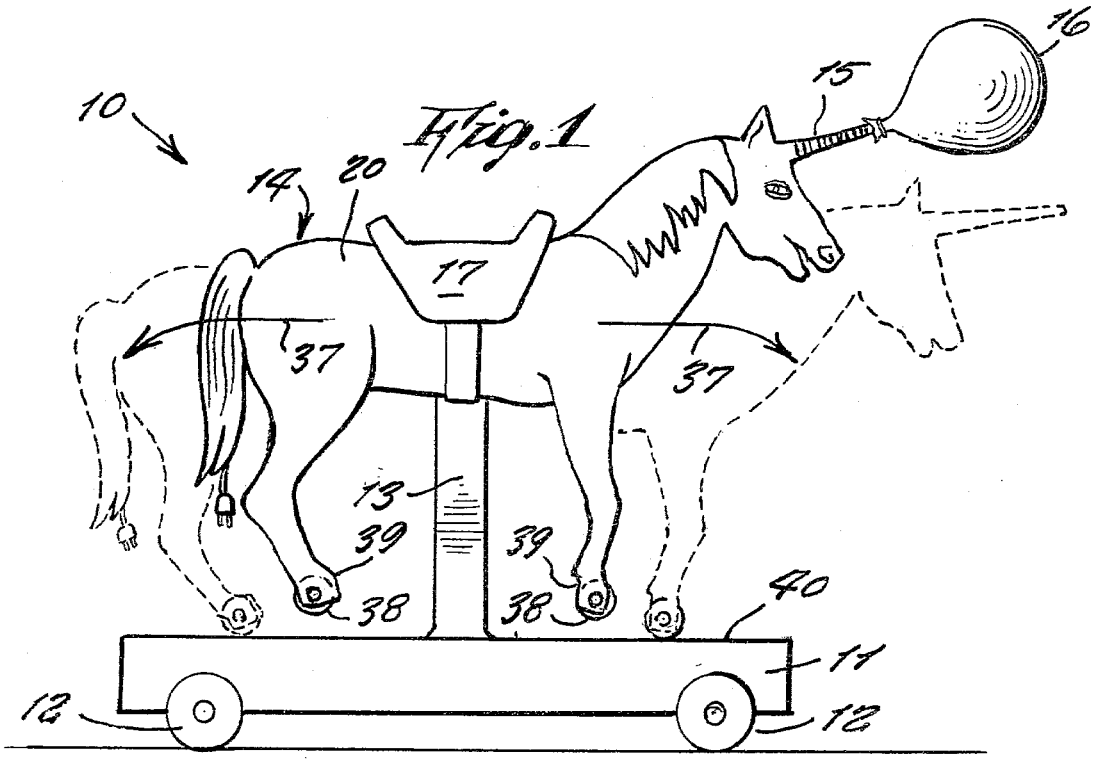
Fig. 1
10
14
20
17
15
16
37
37
13
39
39
38
38
40
11
12
12
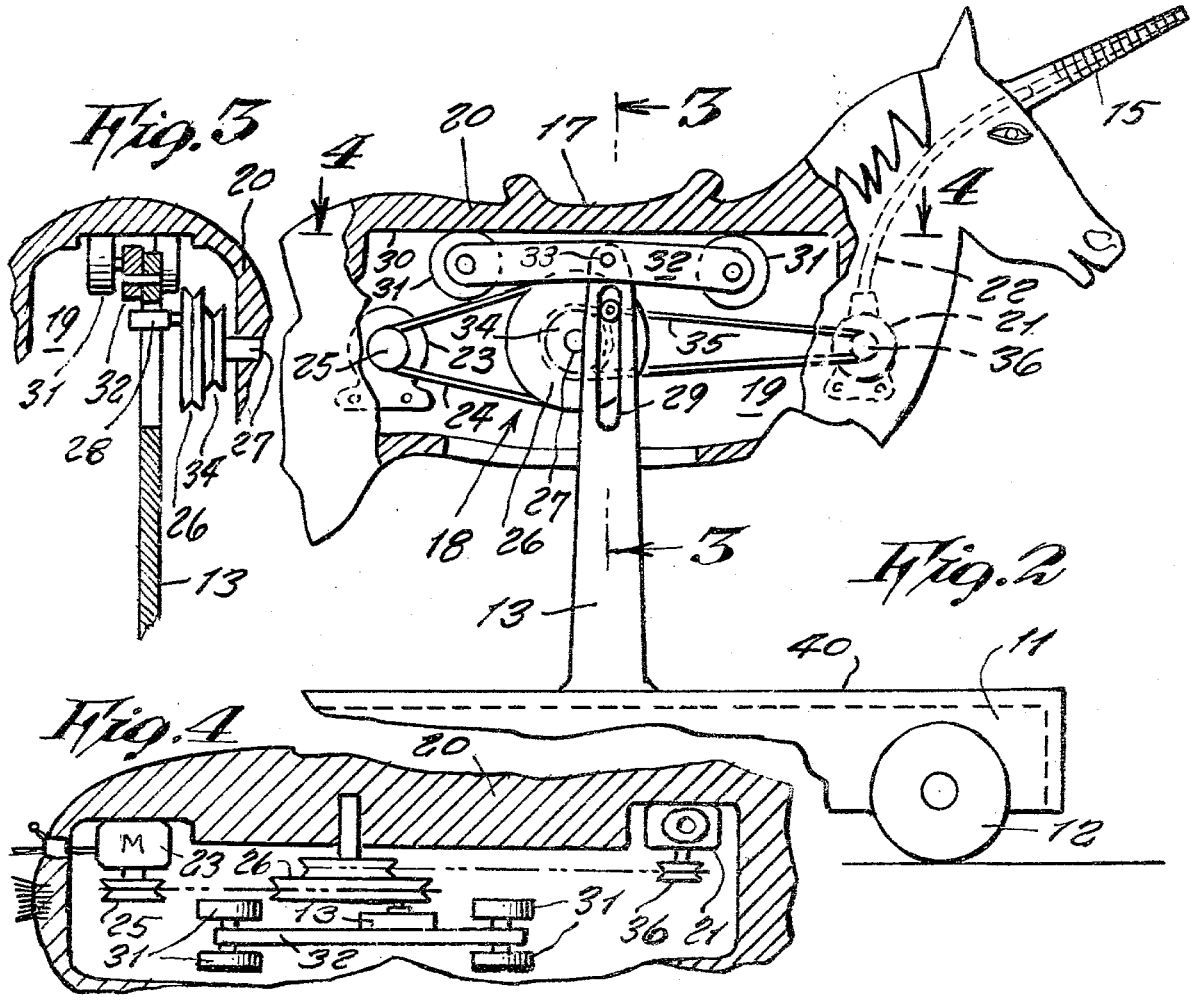
Fig. 3
Fig. 2
Fig. 4
20
17
3
4
4
15
30
33
32
31
31
22
21
34
23
35
36
25
19
29
24
18
26
27
19
31
32
28
34
27
26
13
3
13
40
11
12
20
M
23
26
25
13
31
36
21
31
32

TOY BALLOON PUMP

BACKGROUND OF THE INVENTION

This invention relates generally to children's amusement riding devices.

It is well known that numerous amusement devices have been developed in the past for giving children a pleasure ride.

SUMMARY OF THE INVENTION

It is a principal object of the present invention to provide a child's riding device which, in addition to giving a pleasure ride, also gives the diversion of watching a rubber balloon being slowly inflated larger and larger until it may possibly explode if the ride is continued, so as to give the child the excitement of anticipating such explosion, and judging how long the ride may be continued for attaining a maximum balloon inflation without the balloon bursting.

Another object is to provide an amusement ride wherein the inflated balloon can thereafter be tied up at its maximum size and presented to the child.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a side view of one design of the amusement ride device.

FIG. 2 is an enlarged cross sectional detail view thereof taken in a same plane, so as to illustrate the operating mechanism therein.

FIG. 3 is a transverse cross sectional view taken on line 3—3 of FIG. 2.

FIG. 4 is a top cross sectional view taken on line 4—4 of FIG. 2.

DETAILED DESCRIPTION OF PREFERRED EMBODIMENT

Referring now to the drawing in greater detail, the reference numeral 10 represents a toy balloon pump, according to the present invention, wherein there is a platform 11 mounted upon wheels 12, the platform including a rigid post 13 thereupon. A FIG. 14 such as that of a horse-like unicorn having a horn 15 projecting from its forehead, serves for a rubber balloon 16 to be fitted thereupon in order to be inflated.

The FIG. 14 is shaped with a saddle 17 thereupon so that children may sit and ride thereupon.

A mechanism 18 is contained within the hollow interior chamber 19 of the finger's body 20, and drives an air pump 21 connected by flexible hose 22 to the horn 15 which is tubular so that the pump can inflate the balloon.

The mechanism constitutes a mechanical linkage between the figure body 20 and the post 13 so that the FIG. 14 is thus carried thereupon. The mechanism includes an electric motor 23 mounted inside the body and which by means of endless belt 24 and motor pulley 25 rotates a large pulley 26 affixed on a shaft 27 supported on the body. An eccentric pin 28 on the pulley 26 engages a vertical slot 29 on the post 13 that projects into the interior chamber 19. This causes the body to shift forwardly and rearwardly at each turn of the pulley 26. This shifting is made relatively more friction free by means of a horizontal surface 30 of the body resting upon rollers 31 pivotable at opposite ends of a lever 32 that rocks at its center on a pivot pin 33 mounted at the upper end of the post.

A pulley 34 also affixed to pulley 26 and shaft 27 drives an endless belt 35 passed around a pulley 36 on the air pump.

In operative use, as the FIG. 14 slides forwardly and rearwardly, with rider thereupon, and at a same time inflates the balloon, the figure tilts downwardly at each end of its rearwardly-forwardly stroke, due to inbalance, as shown by the dotted lines and arrows 37 in FIG. 1, so that wheels 38 under the hoofs 39 of the figure slide upon the top surface 40 of the platform.

In addition if desired an adult person may manually push the horse back and forth with the electric motor off and thereby participate with the child in blowing up a balloon and giving the child a ride.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A toy balloon pump, comprising in combination, a platform, a stationary post on said platform, a figure supported by means on said post permitting forward and rearward reciprocal movement in rolling engagement of said figure with respect to said post and platform, a child's seat upon said figure, a tubular horn formed upon said figure upon which an inflatable balloon may be fitted, and an air pump associated with said support means and figure for discharging air through said tubular horn for inflating a balloon on reciprocal movement of said figure.

2. The combination as set forth in claim 1, wherein a motor driven mechanism is mechanically linked between said support means and the hollow body of said figure, said mechanism driving said body and consequently shifting said figure forwardly and rearwardly resulting in the driving of said air pump.

3. The combination as set forth in claim 2, wherein wheels are provided on said figure for rolling upon a top surface of said platform.

* * * * *